US008495829B2

(12) United States Patent
Bekker et al.

(10) Patent No.: US 8,495,829 B2
(45) Date of Patent: Jul. 30, 2013

(54) PRINTABLE WRISTBAND FORM

(75) Inventors: Alexander Bekker, Sherman Oaks, CA (US); Shane Taghavi, Woodland Hills, CA (US)

(73) Assignee: Precision Dynamics Corporation, Valencia, CA (US)

( * ) Notice: Subject to any disclaimer, the term of this patent is extended or adjusted under 35 U.S.C. 154(b) by 93 days.

(21) Appl. No.: 13/105,709

(22) Filed: May 11, 2011

(65) Prior Publication Data

US 2012/0285058 A1 Nov. 15, 2012

(51) Int. Cl.
*A44C 5/00* (2006.01)

(52) U.S. Cl.
USPC ..... 40/633; 40/665

(58) Field of Classification Search
USPC ..... 40/633, 665; 283/75
See application file for complete search history.

(56) References Cited

U.S. PATENT DOCUMENTS

| | | | | |
|---|---|---|---|---|
| 6,748,687 | B2 | 6/2004 | Riley | |
| 8,091,261 | B2 * | 1/2012 | Chadwick | 40/633 |
| 2008/0236011 | A1 | 10/2008 | Bekker | |
| 2008/0309065 | A1 | 12/2008 | Ali et al. | |
| 2009/0094872 | A1 | 4/2009 | Ali et al. | |

* cited by examiner

*Primary Examiner* — Joanne Silbermann
(74) *Attorney, Agent, or Firm* — Kelly & Kelley, LLP

(57) ABSTRACT

A printable wristband form includes a plurality of wristbands cut into a multi-layer sheet of the form. Each wristband includes a release tab formed at an end thereof. A release liner is disposed between layers of the sheet in a single region defined by the release tabs. The form preferably includes adult sized wristbands and infant sized wristbands arranged on the same sheet for use in hospital maternity settings.

23 Claims, 6 Drawing Sheets

PRINTABLE WRISTBAND FORM

BACKGROUND OF THE INVENTION

The present invention generally resides in a printable wristband form. More particularly, the present invention resides in a wristband form having a plurality of wristbands and a release liner disposed only between the layers of the sheet in a single region defined by wristband release tabs.

Identification bands, such as a wristband, bracelet, or other closed-loop identification device are generally known in the art. These bands carry some form of information concerning an identified object. Wristbands typically comprise an elongated flexible strap formed from plastic material or the like.

Wristbands are used in many applications, including particularly in hospitals or the like for patients upon admission. In such instances, when a patient is admitted, information is taken from the patient with respect to his or her medical history, and, during the course of the patient's stay, it is not unlikely that various kinds of medications and treatments are given to the patient. For these reasons, and others, it is important to keep track of the patients in a reliable manner with an identification band which will withstand the vagaries of a hospital environment. Such hospital bracelets or wristbands have been in use for many years. More recently, such wristbands have been formed as blanks in a sheet of material, with the wristband having information, including oftentimes a barcode, relating to or identifying the patient.

One very common situation in a hospital setting is when a pregnant mother is admitted or otherwise processed in connection with the birth of her baby. The mother, and perhaps the father, upon admission would need to be given a wristband identifying the parents. Typically a few hours later, the newborn baby would need at least one, and possibly two, wristbands (for the infant's wrist and/or ankle). Typically, information will be provided on the wristband as it relates to the mother as a patient and also as the parent of the newborn baby. The newborn baby's information on the wristband would also include necessary medical information as a patient, as well as identification that the baby belonged to his or her parents. Typically, the father's information on the wristband will only pertain to his association with the mother and baby.

It will be appreciated that the size of the wristbands required for the parents and the newborn infant are quite different from one another. The infant's wristband will of necessity be smaller in size so as to be secured around the infant's ankle or wrist. The parents' wristbands, on the other hand, will need to be much larger to fit around their wrists. Another consideration is that the infant's wristband must still have a sufficiently large portion so as to provide the necessary identification and medical information. It will be appreciated that there are other situations where adults and children, such as parents and children, may need to be issued wristbands for admittance, tracking, etc. Having a form or sheet with only large or adult sized wristbands and another form or sheet having smaller child or infant wristbands is easier to manufacture and produce, but yields complications in use. It would be much easier for the end user to be able to print a single sheet or form having a plurality of wristbands to accommodate both the parents and the child.

This is particularly the case in the hospital maternity setting in which there have been instances in the past where babies and parents have been misidentified and parents have actually raised the wrong child. In order to avoid these mistakes, a single sheet having wristbands for both the parents as well as the newborn infant is preferred as it will be easier for the hospital staff to correlate the parents with the newborn baby. Thus, an object of the present invention is to combine on a single form the wristbands necessary so that software may be conveniently written to allow its automatic processing by the admitting clerk all at the same time without re-loading paper trays on printers or requiring additional printers. This ensures that the same, and correct, identifying information is printed on the bands, which also provides additional security for the baby and family as an aid in preventing unauthorized people from gaining access to the baby and also helps prevent any mistaken identity by the medical personnel in relating the baby to his/her correct parents.

It has become common practice that such wristbands have a release tab formed typically at an end thereof which can be pulled away to expose adhesive such that the one end of the wristband can be attached to another portion of the wristband to encircle about the object to be identified, such as a wrist of a patient, and be retained in place. The release tab requires a release liner to be disposed between the multiple layers or plys of the form or sheet. The release liner, typically a silicone-based material, allows the release tab to be easily removed. However, the release liner material often presents manufacturing and even end user printing difficulties. The release liner material and adhesives tend to ooze and create jamming during manufacturing of the forms. This requires periodic stoppage of the dies and machinery, which then need to be cleaned. When printing, if the release liner or adhesive material oozes from between the layers of the form, it can create jamming of the printer. A release liner disposed over a large portion of the form can also result in the undesirable peeling of the layers from one another.

Accordingly, there is a continuing need for a printable wristband form which minimizes the problems associated with release liner and adhesive oozing and unintended separation of layers of the wristband. What is also needed is a printable wristband form which is specifically designed and configured for use by both adults and children, such as in a maternity setting. The present invention fulfills these needs, and provides other related advantages.

SUMMARY OF THE INVENTION

The present invention resides in a printable wristband form generally comprising a multi-layer sheet having a printable layer and a base layer adhered to one another. Typically, the base layer comprises a plurality of layers attached to one another.

A plurality of wristbands are cut into the multi-layer sheet. Each wristband has an information portion and a strap portion. Typically, the strap portion of each wristband is narrower than the identification portion. In a preferred embodiment, adjacent wristbands are offset from one another in alternating fashion such that an end of the information portion of a first wristband is oriented towards a first end of the sheet, while an end of a strap portion of a second adjacent wristband is oriented towards the first end of the sheet. A release tab is formed at an end of each wristband.

The release tabs are typically formed by cuts formed through the base layer. The wristbands may include tamper cuts formed through an end thereof, typically through the printable layer. A slit may be formed in the wristband which is configured to receive an end of the strap therethrough.

Preferably, the ends of the wristbands having the release tab are generally aligned with one another. For example, the ends of the wristband having the release tab may be disposed adjacent to the first end of the sheet.

A release liner is disposed between the printable layer and the base layer of the multi-layer sheet in a single region defined by the release tabs. The release liner extends less than a length of the sheet, and even less than a length of the wristbands so as to be disposed only in a single region defined by the release tabs. In the case where the ends of the wristband having the release tab are disposed adjacent to the first end of the sheet, the release liner region is disposed adjacent to the first end of the sheet.

In a particularly preferred embodiment, the plurality of wristbands comprise at least one wristband of a first size and at least one wristband of a second, smaller size. The one or more wristbands of the first size are configured to be used by an adult and the one or more wristbands of the second, smaller size are configured to be used by a child. In a particularly preferred embodiment, the plurality of wristbands formed on the sheet comprise two wristbands of a smaller size configured for an infant and two wristbands of a larger size configured for parents of the infant.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

As shown in the exemplary drawings, for purposes of illustration, the present invention is concerned with a novel printable wristband form, generally referred to by the reference number 10. Different embodiments of the inventive wristband form 10 will be described below.

Figure 1:
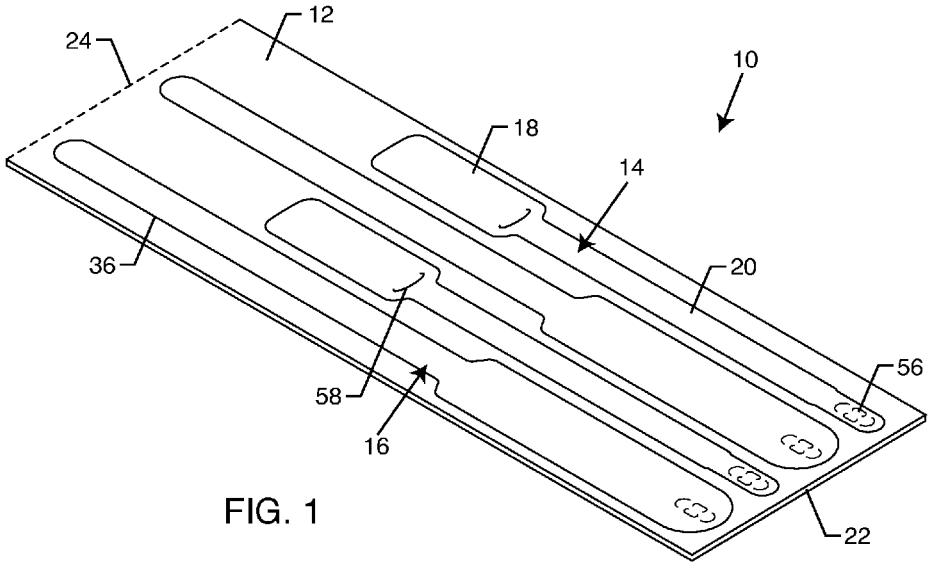
FIG. 1 is a top perspective view of a wristband form embodying the present invention.
Figure 2:
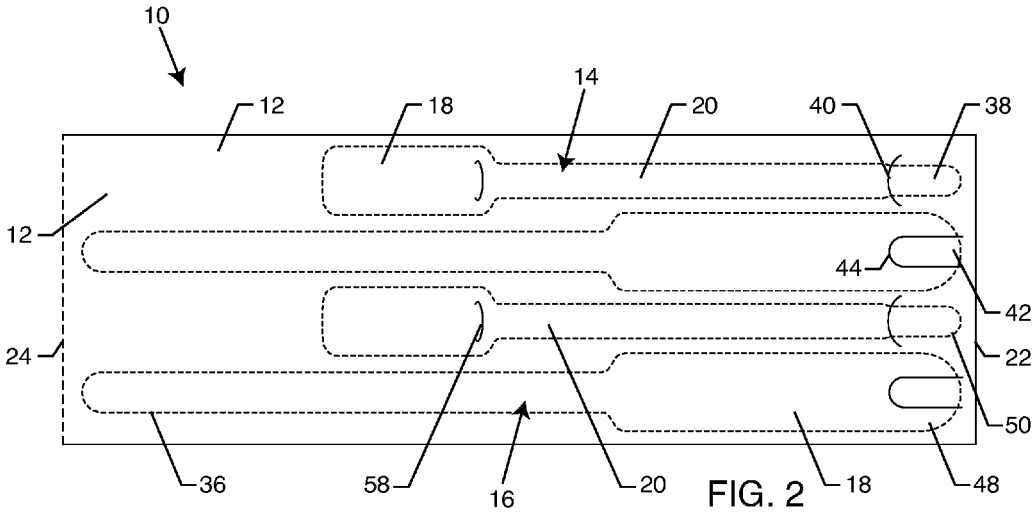
FIG. 2 is a bottom plan view of the form of FIG. 1.

With reference now to FIGS. 1 and 2, the form 10 is generally comprised of a multi-layer sheet 12 having a plurality of wristbands 14 and 16 formed therein. Each wristband has an information portion 18 sufficiently large so as to receive the necessary printed information pertaining to the patient or other object thereon, and a strap portion 20 formed integrally with the information portion 18. The information portion 18 is sufficiently large so as to have the patient's name, age, barcodes, and any other information which is required or otherwise pertinent and desirable to identify the patient. As will be explained more fully herein, this information is typically printed on the blank wristband 14 or 16 of the form 10 at the hospital or other setting.

As can be seen in FIGS. 1 and 2, the multi-layer sheet has a first end 22 and a second end 24. These ends 22 and 24 define a width of the sheet 12. In between the ends 22 and 24 comprises the length of the sheet 12. The sheet is typically of a sufficient size so as to have a plurality of wristbands 14 and 16 formed therein and the sheet 12 fed through a printer. In a particularly preferred embodiment, there are four wristbands of different sizes, as illustrated. However, it will be appreciated that the invention contemplates that the wristbands be not of two different sizes, but instead could be of the same general size and configuration, or of different sizes and configurations.

Figure 3:
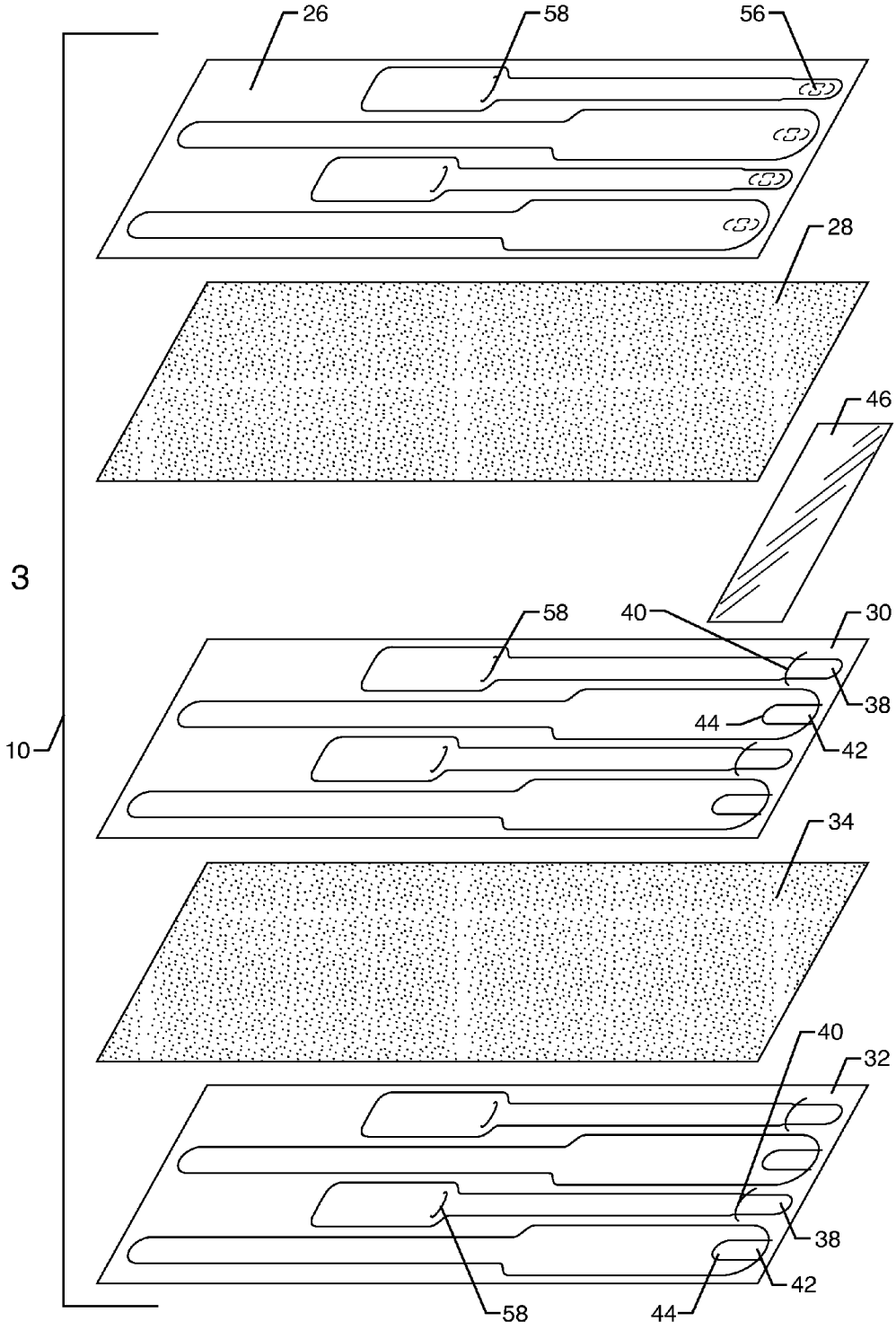
FIG. 3 is an exploded perspective view of the form of FIG. 1, illustrating the various component parts and layers thereof.
Figure 4:
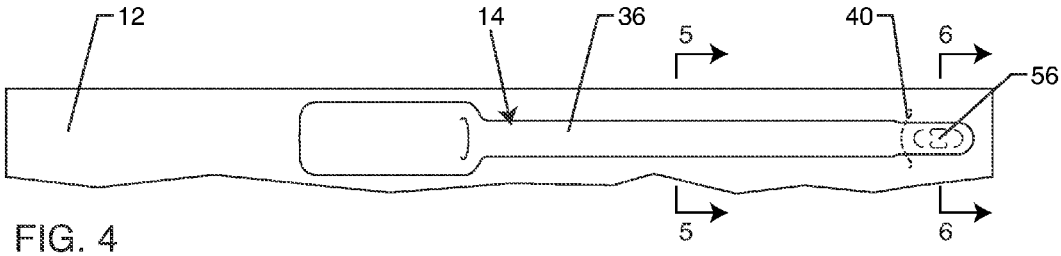
FIG. 4 is a partially fragmented top plan view of a form, illustrating a single wristband thereof.
Figure 5:
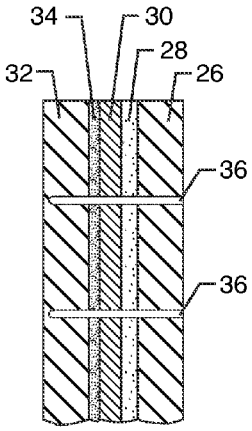
FIG. 5 is a cross-sectional view taken generally along line 5-5 of FIG. 4.

With reference now to FIGS. 3-5, the multi-layer sheet of the form 10 includes a printable layer or sheet 26, such as thermo-sensitive stock so as to receive printing from a thermal printer, a material capable of receiving print from a laser printer, or the like. A layer of adhesive 28 adheres the top printable layer 26 to a backing or base layer. In the illustrated embodiment, the base layer is comprised of a plurality of layers 30 and 32 connected to one another, such as by means of adhesive layer 34. For example, base layer 32 could comprise polyethylene adhered to a polyester layer 30 by means of an adhesive 34, such as UV adhesive. Such material would provide wristbands 14 and 16 formed from a flexible, non-stretchable materials having machine-imprintable characteristics.

Figure 8:
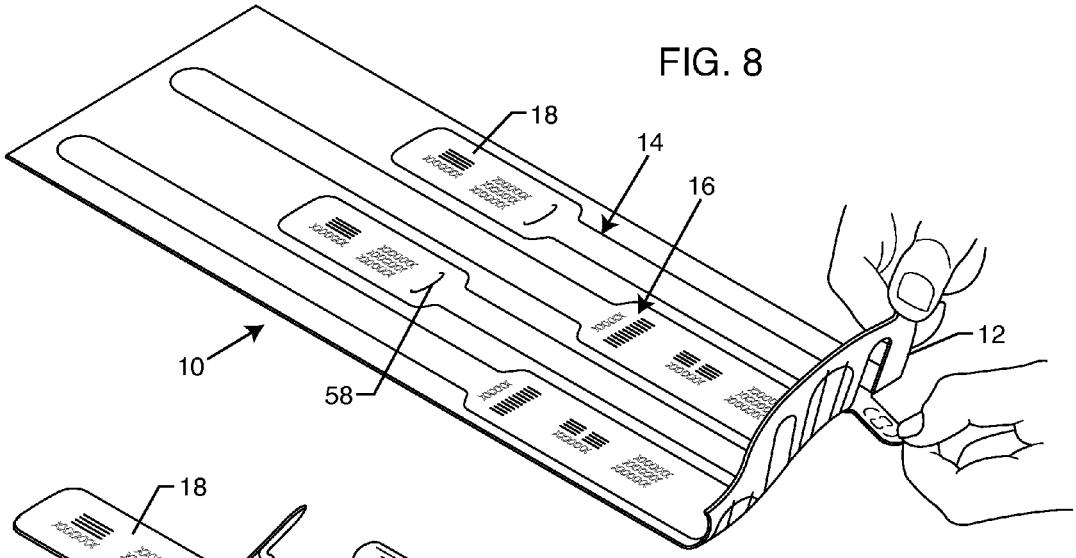
FIG. 8 is a perspective view illustrating the removal of a wristband from the form.

The wristbands 14 and 16 are defined and formed in the sheet 12 by means of score lines 36 in the form of kiss cuts which extend substantially through the layers 26-34 so as to permit the individual wristbands to be torn out from the sheet 12 when needed. Typically, as illustrated in FIG. 5, such score lines or cuts 36 extend through the top printable layer 26, and almost through the base layers 30 and 32 such that the wristbands 14 and 16 are not completely cut out of the sheet 12, but can be manually torn away from the surrounding material, as illustrated in FIG. 8, when desired.

Referring again to FIGS. 2 and 3, release tabs 38 and 42 are formed at an end of each wristband. The release tab is formed by means of a cut or score line 40 or 44 which extends through the base layers 30 and 32.

Figure 6:
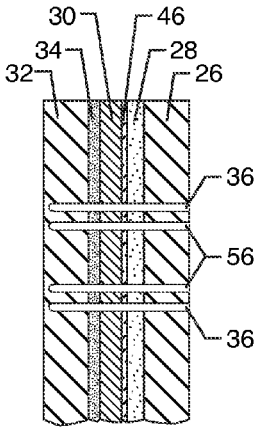
FIG. 6 is a cross-sectional view taken generally along line 6-6 of FIG. 4.
Figure 9:
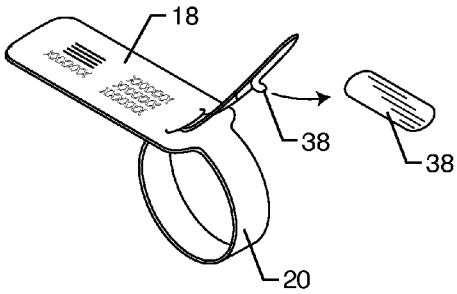
FIG. 9 is a perspective view of a release tab being removed from a wristband, in accordance with the present invention.
Figure 10:
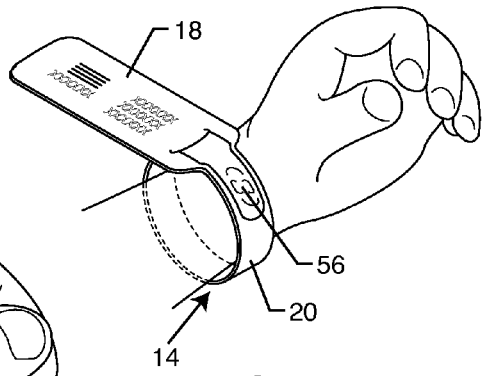
FIG. 10 is a perspective view of the wristband of FIG. 9 attached to a child's wrist.
Figure 11:
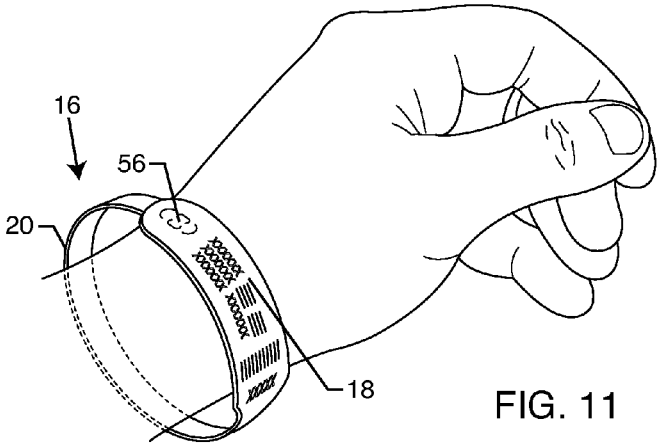
FIG. 11 is a perspective and diagrammatic view of a wristband of the present invention placed on an adult's wrist.

With reference now to FIGS. 3, 4 and 6, in accordance with the present invention, a release liner 46, such as a silicone-based material, is disposed between the printable layer 26 and the base layers 30 and 32. More particularly, the release liner 46 is disposed between layer 30 and adhesive layer 28. As the release tab 38 is removed when attaching a wristband, as illustrated in FIG. 9, a portion of the adhesive layer 28 underlying the release tab 38 or 42 is exposed enabling the adhesive portion to be fixably attached to another portion of the wristband wrapped around the object, as illustrated in FIGS. 10 and 11.

In accordance with the present invention, the release liner is disposed between the printable layer 26 and base layers 30 and 32, and more particularly adhesive layer 28 and base layer 30, in a single region defined by the area of the release tabs 38 and 42 of the wristbands of the sheet. It can clearly be seen in FIG. 3 that the region of release liner 46 is much smaller than the length of the sheet 12. In fact, the region of release liner 46 is much smaller than the length of the wristbands 14 and 16 themselves as well. Preferably, the release liner region 46 is generally limited to an area substantially covering or surrounding the release tabs 38 and 42.

In a particularly preferred embodiment, as illustrated, the ends of the wristbands having the release tabs 38 and 42 are generally aligned with one another so as to minimize to the greatest extent possible the region of the single release liner 46. One way of accomplishing this, which is also desirable from an ease of manufacturing standpoint, is to align the ends of the wristband with one another adjacent to an end 22 of the sheet 12, as illustrated. In order to maximize the material and space of the sheet 12, adjacent wristbands are offset from one another in alternating fashion such that an end 48 of the information portion of a first wristband 16 is oriented towards and adjacent to the first end 22 of the sheet, and an end 50 of a strap portion 20 of a second adjacent wristband is oriented towards and disposed adjacent to the first end of the sheet 22, as illustrated in FIGS. 1 and 2. In this manner, the larger identification portions 18 are separated from one another by the narrower strap portions 20 so as to maximize the space of the sheet 12. Preferably, the sheet 12 is of a length slightly longer than the length of the largest wristband and of a width slightly larger than the combined widths of the wristbands 14 and 16. In large quantities, even a small difference in material cost can result in significant savings. Thus, this arrangement provides a material cost savings, particularly when considering that the forms and sheets 10 and 12 are formed in the many of thousands during manufacturing, often in detachable rolls 52, as illustrated in FIG. 7.

A further advantage of such an arrangement is that the tabs 38 and 42 are disposed adjacent to one another and in a generally aligned fashion adjacent to the first end 22 of the sheet 12. Thus, the region of release liner 46 can be easily placed adjacent to the first end 22 of the sheet 12 so as to extend substantially the width thereof, but only extend a length sufficient to extend beyond the release tabs 38 and 42.

As described above, limiting the amount and area of the release liner 46 has advantages to both the manufacture from not only a material conservation standpoint, but also to enhance the manufacturing process by limiting the otherwise oozing out of the release liner 46 and adhesives during the manufacturing process. Moreover, a more reliable form 10 is created, wherein the printable layer 26 and base layers 30 and 32 are less likely to peel away from one another, such as when passing the form 10 through a printer.

Figure 7:
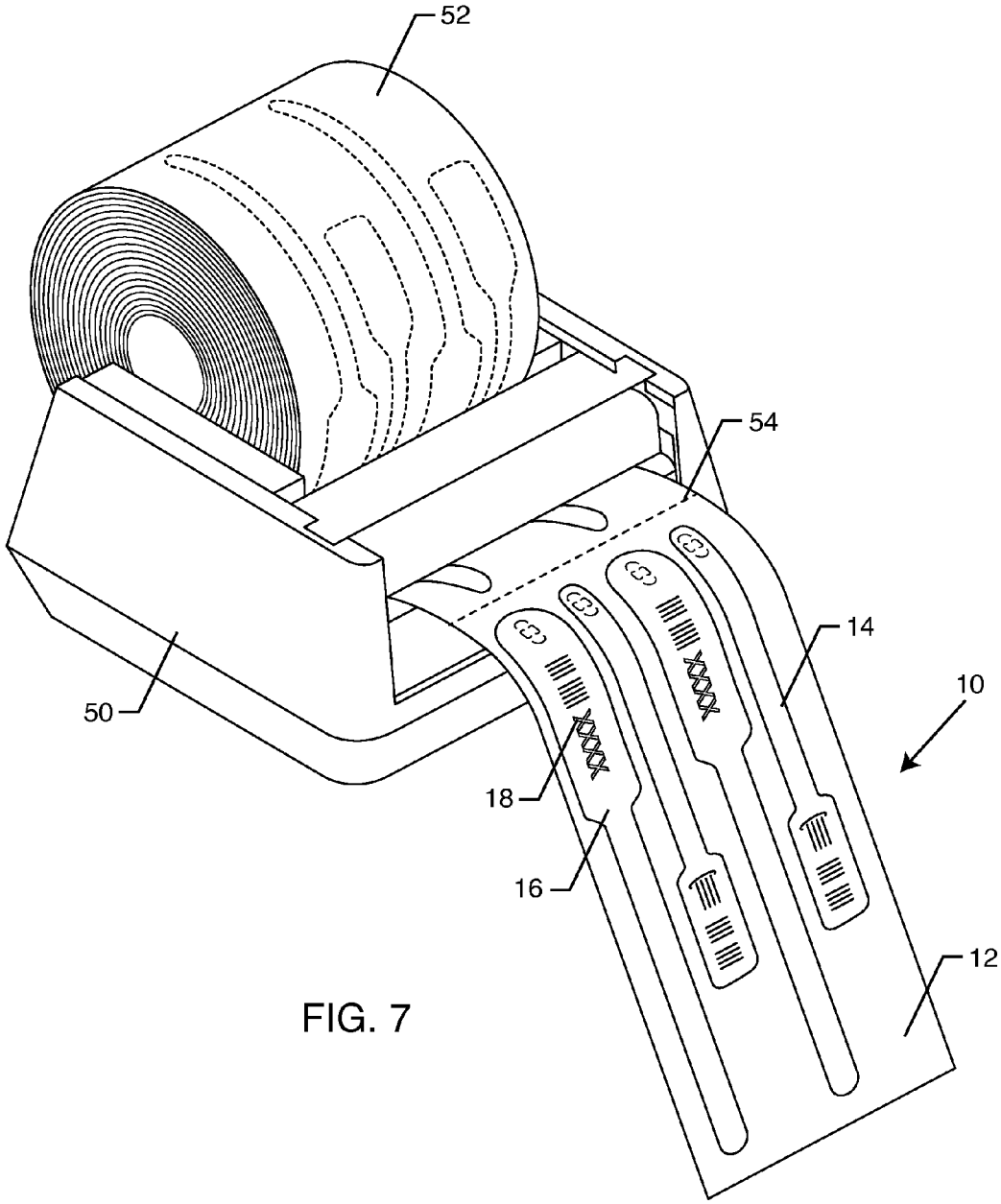
FIG. 7 is a perspective view of a roll of detachable forms fed through a printer, in accordance with the present invention.

With reference now to FIG. 7, as described above, the forms 10 are sent through a printer, typically at the hospital, so as to print identifying information regarding the patient, or other object to which the wristband 14 or 16 is attached. As described above, this information is typically printed in the larger information portion 18 of the wristband 14 or 16. In one embodiment, as illustrated in FIG. 7, a plurality of forms 10 are detachable connected together end-to-end forming a roll 52 which can be fed individually through the printer 50, as illustrated in FIG. 7. Score lines 54 provide a line of detachment between adjacent forms 10. It will also be appreciated by those skilled in the art that the form 10 can comprise independent sheets which can be individually fed through other types of printers, such as a laser printer, instead of being attached to one another and formed in a roll, as illustrated in FIG. 7. The wristbands 14 or 16, after printing, can then be removed from the form 10, as illustrated in FIG. 8, and encircled about an object, such as a wrist of a patient, as illustrated in FIGS. 10 and 11, with an end of the wristband having the release tab 38 or 42 removed therefrom adhered onto another portion of the wristband so as to secure the wristband in place on the object.

As a security measure, preferably, the wristband includes tamper cuts 56 at the area of attachment, such that if the wristband is removed from the object, the tamper cuts will destroy the end of the wristband, rendering it difficult or even impossible to reconnect. Such tamper cuts are illustrated throughout the drawings, including FIGS. 5 and 6. Typically, the tamper cuts 56 are formed in the printable layer 26 generally above the release tabs 38 or 42. This would place the tamper cut portion 56 at the position of connection and adhesion, such that if the wristband were attempted to be removed the tamper cuts 56 would break or shear, rendering the wristband useless.

The form 10 of the present invention is particularly suited for use in a maternity setting of a hospital. A single form 10 would have a plurality of larger, adult size wristbands 16 and at least one, and preferably a plurality, of smaller wristbands 14 configured to fit an infant. When admitted to the hospital, the wristband blanks 14 and 16 would have information printed thereon, as illustrated in FIG. 7, identifying the mother as a patient, the baby to be birthed during the hospital stay, as well as a father or other loved one. All three individuals could have their information printed on the wristbands 14 and 16 of a single form 10 at once.

The wristband 16 for the mother could be immediately placed on the mother's wrist, as illustrated in FIG. 11. This would entail detaching the wristband from the form, as illustrated in FIG. 8, looping the strap portion 20 around the mother's wrist, removing the release tab 42, and adhering the end 48 of the wristband to an exposed portion of the wristband so as to secure it to the user, as illustrated in FIG. 11. A similar process would be involved with attaching the second adult sized wristband to the other parent or loved one. The form or sheet 10, 12 having the remaining smaller wristbands 14 still attached thereto could be kept in the birthing room or in the file associated with the mother. After the birth of the child, at least one of the pre-printed smaller wristbands 14 would be attached to the newborn infant. It is becoming common practice to attach such identification wristbands to both the wrist and ankle of the child. Thus, a form 10, as illustrated, having two adult sized wristbands 16 and two infant sized wristbands 14 is particularly desirable and convenient in such a maternity setting.

It will be appreciated that the relatively small size of the infant's wristband 14 can present difficultly in providing a sufficiently large area to print information relating to the infant and which can be easily visually read or machine read by hospital personnel. Thus, in a particularly preferred embodiment, a slit 58 is formed through all of the layers of the sheet and which is of a sufficient width or size so as to receive an end of the strap 20 therethrough, as illustrated in FIGS. 9 and 10. This enables the release tab 38 to be removed and an end of the strap to be attached to an exterior portion of the looped strap, as illustrated in FIG. 10, while still presenting a sufficiently large information portion 18 freely extending away from the encircled strap 20, which would otherwise be too large to be wrapped around the baby's wrist or ankle, and which also enables the hospital personnel to manipulate and read the extending information portion 18. Without such an arrangement, the otherwise relatively large information portion 18 of the strap would need to be encircled about the infant's ankle or wrist, which would not only be uncomfortable to the infant but also render the reading of the information on the information portion 18 difficult for the hospital personnel.

Figure 14:
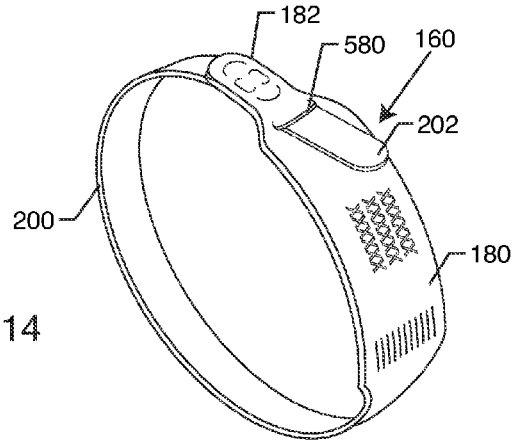
FIG. 14 is a perspective view of an adult wristband of the form of FIG. 12.
Figure 12:
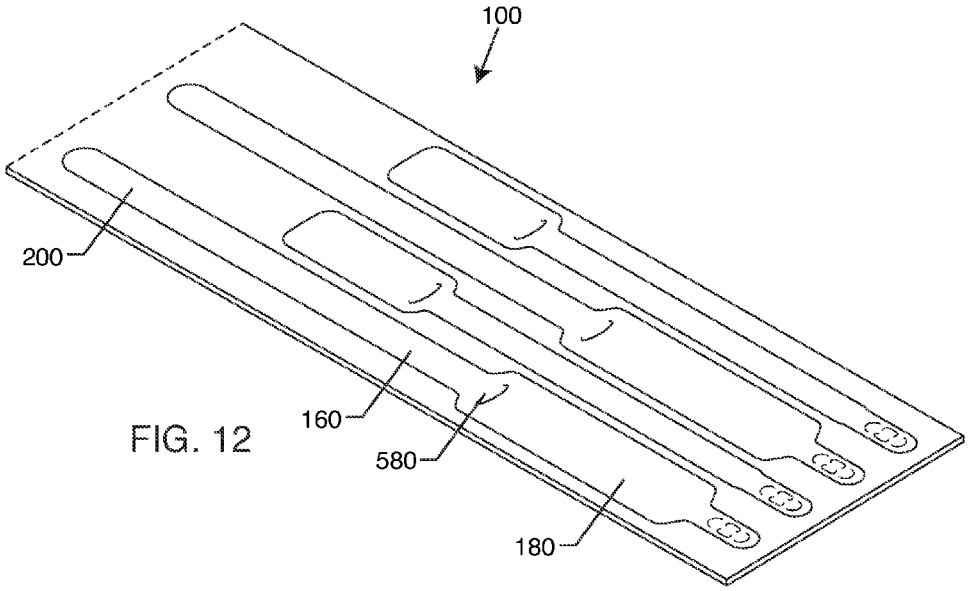
FIG. 12 is a top perspective view of another form embodying the present invention.
Figure 13:
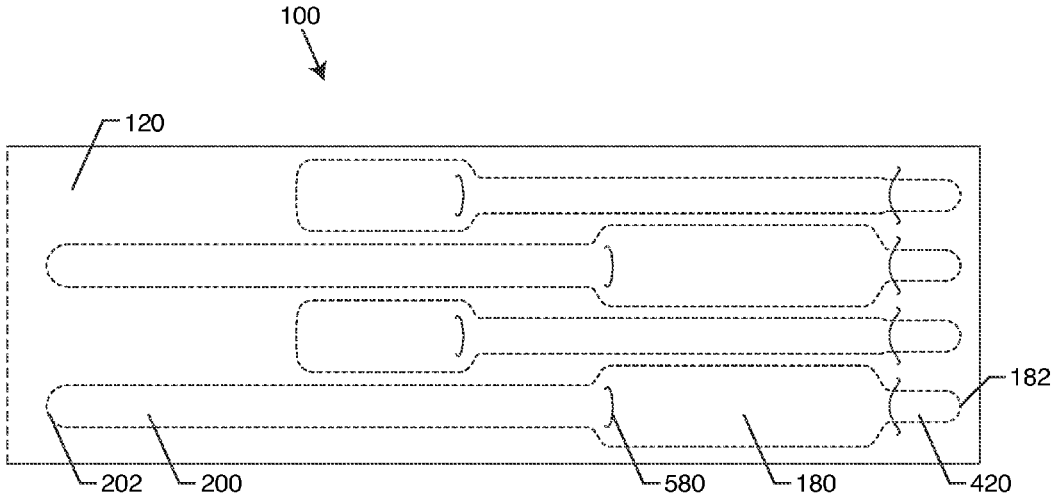
FIG. 13 is a bottom plan view of the form of FIG. 12.

Another advantage of the slit 58 arrangement is that the end of the strap, when extended through the slit 58 is substantially aligned with the portion of the wristband to which it is to be attached. Thus, with reference now to FIGS. 12-14, this same arrangement can be effectively utilized for the larger adult wristbands as well. As shown in FIGS. 12 and 13, a slit 580 is formed in the adult wristband 160, typically in the enlarged information portion 180 so as to accommodate an end 202 of the strap 200 to be inserted therethrough, as illustrated in FIG. 14. Instead of the release tab 42 being formed in the enlarged information area 18, as illustrated in the embodiment of FIGS. 1 and 2, a release tab area 420 at end 182 of a size approximating the width of the strap 200 is provided. Thus, when wrapping and encircling the strap 200 around the object, such as the adult's wrist, the end 202 of the strap is inserted through the slit 580, and the opposite end 182 of the strap is adhered onto the exposed area of the wristband, typically a portion of strap 200, as illustrated in FIG. 14. As the end 202 of the strap 200 must be inserted through the slit 580, end 182 is automatically aligned with the exposed strap 200.

Although several embodiments have been described in detail for purposes of illustration, various modifications may be made without departing from the scope and spirit of the invention. Accordingly, the invention is not to be limited, except as by the appended claims.

What is claimed is:

1. A printable wristband form, comprising:

a multi-layer sheet including a printable layer and a base layer adhered to one another;

a plurality of wristbands cut into the multi-layer sheet, each wristband having an information portion and a strap portion;

a release tab formed at an end of each wristband; and a release liner disposed between the printable layer and the base layer in a single region defined by the release tabs and extending less than a length of the sheet;

wherein the ends of the wristbands having the release tab are generally aligned with one another; and wherein adjacent wristbands are offset from one another in alternating fashion such that an end of the information portion of a first wristband is oriented towards a first end of the sheet and an end of a strap portion of a second adjacent wristband is oriented towards the first end of the sheet.

2. The wristband form of claim 1, wherein the release liner region extends less than a length of the wristbands.

3. The wristband form of claim 1, wherein the ends of the wristband having the release tab are disposed adjacent to a first end of the sheet.

4. The wristband form of claim 3, wherein the release liner region is disposed adjacent to the first end of the sheet.

5. The wristband form of claim 1, wherein the strap portion of each wristband is narrower than the identification portion.

6. The wristband form of claim 5, including a slit formed in at least one of the wristbands configured to receive an end of the strap therethrough.

7. The wristband form of claim 1, wherein the plurality of wristbands comprise at least one wristband of a first size and at least one wristband of a second, smaller size.

8. The wristband form of claim 7, wherein the at least one wristband of the first size is configured to be used by an adult and the at least one wristband of the second, smaller size is configured to be used by a child.

9. The wristband form of claim 7, wherein the plurality of wristbands comprise two wristbands of the second, smaller size configured for an infant and two wristbands of the first size configured for parents of the infant.

10. The wristband form of claim 1, including tamper cuts formed at an end of each wristband.

11. The wristband form of claim 10, wherein the tamper cuts are formed through the printable layer and release tab cuts are formed through the base layer.

12. The wristband form of claim 1, wherein the base layer comprises a plurality of layers attached to one another.

13. A printable wristband form, comprising:

a multi-layer sheet including a printable layer and a base layer adhered to one another;

a plurality of wristbands cut into the multi-layer sheet, each wristband having an information portion and a narrower strap portion, the wristbands being offset from one another in alternating fashion such that an end of the information portion of a first wristband is oriented towards a first end of the sheet and an end of a strap portion of the second adjacent wristband is oriented towards the first end of the sheet, the end of the strap portion and the end of the information portion being generally aligned with one another;

a release tab formed at the aligned ends of each of the wristbands; and a release liner disposed between the printable layer and the base layer in a single region defined by the release tabs and extending less than a length of the wristbands.

14. The wristband form of claim 13, wherein the ends of the wristband having the release tab are disposed adjacent to a first end of the sheet, and the release liner region being disposed adjacent to the first end of the sheet.

15. The wristband form of claim 13, including a slit formed in at least one of the wristbands configured to receive an end of the strap therethrough.

16. The wristband form of claim 13, wherein the plurality of wristbands comprise at least one wristband of a first size and at least one wristband of a second, smaller size.

17. The wristband form of claim 16, wherein the at least one wristband of the first size is configured to be used by an adult and the at least one wristband of the second, smaller size is configured to be used by a child.

18. The wristband form of claim 16, wherein the plurality of wristbands comprise two wristbands of the second, smaller size configured for an infant and two wristbands of the first size configured for parents of the infant.

19. The wristband form of claim 13, including tamper cuts formed through the printable layer of each wristband, and wherein the release tab cuts are formed through the base layer of each wristband.

20. A printable wristband form, comprising:

a multi-layer sheet including a printable layer and a base layer adhered to one another;

a plurality of wristbands cut into the multi-layer sheet, each wristband having an information portion and a narrower strap portion, the wristbands being offset from one another in alternating fashion such that an end of the information portion of a first wristband is oriented towards a first end of the sheet and an end of a strap portion of the second adjacent wristband is oriented towards the first end of the sheet, the end of the strap portion and the end of the information portion being generally aligned with one another;

a release tab formed at the aligned ends of each of the wristbands; and a release liner disposed between the printable layer and the base layer in a single region defined by the release tabs and extending less than a length of the wristbands;

wherein the plurality of wristbands comprise two wristbands of a smaller size configured for an infant and two wristbands of a larger size configured for parents of the infant.

21. The wristband form of claim 20, wherein the ends of the wristband having the release tab are disposed adjacent to a first end of the sheet, and the release liner region being disposed adjacent to the first end of the sheet.

22. The wristband form of claim 20, including a slit formed in at least one of the wristbands configured to receive an end of the strap therethrough.

23. The wristband form of claim 20, including tamper cuts formed through the printable layer of each wristband, and wherein the release tab cuts are formed through the base layer of each wristband.

* * * * *